US008992191B2

(12) United States Patent
Ahn et al.

(10) Patent No.: US 8,992,191 B2
(45) Date of Patent: Mar. 31, 2015

(54) SCROLL COMPRESSOR WITH DIFFERENTIAL PRESSURE HOLE

(71) Applicants: Sungyong Ahn, Seoul (KR); Seheon Choi, Seoul (KR); Byoungchan Kim, Seoul (KR); Byeongchul Lee, Seoul (KR)

(72) Inventors: Sungyong Ahn, Seoul (KR); Seheon Choi, Seoul (KR); Byoungchan Kim, Seoul (KR); Byeongchul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 153 days.

(21) Appl. No.: 13/627,064

(22) Filed: Sep. 26, 2012

(65) Prior Publication Data

US 2013/0078131 A1 Mar. 28, 2013

(30) Foreign Application Priority Data

Sep. 28, 2011 (KR) ..... 10-2011-0098596

(51) Int. Cl.
*F03C 2/00* (2006.01)
*F03C 4/00* (2006.01)
(Continued)

(52) U.S. Cl.
CPC ..... *F04C 18/0215* (2013.01); *F04C 23/008* (2013.01); *F04C 29/025* (2013.01); *F04C 29/028* (2013.01); *F04C 18/0253* (2013.01); *F04C 2/10* (2013.01)
USPC ..... 418/55.6; 418/55.1; 418/55.5; 418/57; 418/94; 418/270

(58) Field of Classification Search
CPC ..... F04C 18/0215; F04C 18/0253; F04C 18/0269; F04C 18/0292; F04C 23/008; F04C 29/023; F04C 29/026; F04C 2240/56; F04C 2240/603; F04C 2240/809; F01C 1/0215; F01C 1/0246; F01C 1/0253; F01C 1/0269; F01C 1/0292
USPC ..... 418/88, 94, 55.1–55.6, 57, 102, 270
See application file for complete search history.

(56) References Cited

U.S. PATENT DOCUMENTS 7,134,853 B2 * 11/2006 Yamaji et al. ..... 418/55.5
2009/0035160 A1 * 2/2009 Yoo et al. ..... 418/88
(Continued)

FOREIGN PATENT DOCUMENTS

CN 1401910 A 3/2003
CN 101358598 A 2/2009
(Continued)

OTHER PUBLICATIONS

Korean Office Action dated Oct. 21, 2014, issued in Application No. 10-2011-0098596.
(Continued)

*Primary Examiner* — Theresa Trieu
(74) *Attorney, Agent, or Firm* — Ked & Associates, LLP

(57) ABSTRACT

A scroll compressor is provided that may include a differential pressure hole formed at or in an orbiting scroll that communicates a high pressure part with an intermediate pressure part, a decompression portion formed in the differential pressure hole and having a pin member inserted therein to decompress oil. An inner diameter D1 of the decompression portion may be greater than an outer diameter D2 of the pin member. The decompression portion may include an inlet through which oil may be introduced from the high pressure part into the differential pressure hole, and an outlet through which oil from the differential pressure hole may be discharged into the intermediate pressure part.

20 Claims, 13 Drawing Sheets

(51) Int. Cl.

| | |
|---|---|
| ***F04C 18/00*** | (2006.01) |
| ***F04C 2/00*** | (2006.01) |
| ***F04C 18/02*** | (2006.01) |
| ***F04C 23/00*** | (2006.01) |
| ***F04C 29/02*** | (2006.01) |
| *F04C 2/10* | (2006.01) |

(56) References Cited

U.S. PATENT DOCUMENTS

| | | | | |
|---|---|---|---|---|
| 2010/0122549 | A1* | 5/2010 | Cho et al. | 418/88 |
| 2010/0215534 | A1* | 8/2010 | Kiyokawa et al. | 418/55.5 |
| 2010/0215535 | A1* | 8/2010 | Kiyokawa et al. | 418/55.5 |

FOREIGN PATENT DOCUMENTS

| | | | |
|---|---|---|---|
| CN | 101813088 | A | 8/2010 |
| CN | 102022322 | A | 4/2011 |
| CN | 102062090 | A | 5/2011 |
| JP | 2004-060532 | A | 2/2004 |
| JP | 2005-240693 | A | 9/2005 |
| JP | 2006-241982 | A | 9/2006 |

OTHER PUBLICATIONS

Chinese Office Action dated Oct. 27, 2014, issued in Application No. 201210360962.9 (with English translation).

* cited by examiner

SCROLL COMPRESSOR WITH DIFFERENTIAL PRESSURE HOLE

CROSS-REFERENCE TO RELATED APPLICATION(S)

The present application claims priority to Korean Application No. 10-2011-0098596, filed in Korea on Sep. 28, 2011, which is herein expressly incorporated by reference in its entirety.

BACKGROUND

1. Field

A scroll compressor is disclosed herein.

2. Background

Scroll compressors are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
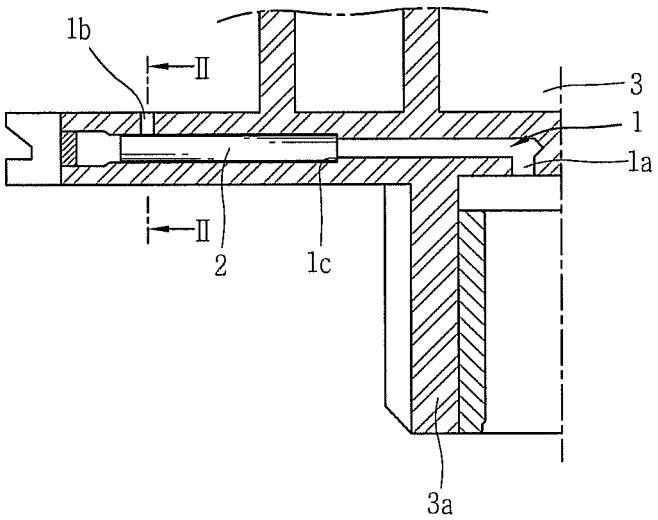
FIG. 1 is a longitudinal sectional view of an oil supplying structure that supplies oil into a compression chamber using differential pressure in a scroll compressor according to an embodiment.

Description will now be given in detail of a compressor in accordance with embodiments, with reference to the accompanying drawings. For the sake of brief description with reference to the drawings, the same or equivalent components will be provided with the same reference numbers, and description thereof will not be repeated.

A refrigerant compression type refrigeration cycle may be configured by connecting a compressor, a condenser, an expansion apparatus, and an evaporator via a closed loop refrigerant pipe. A refrigerant compressed in the compressor may circulate sequentially via the condenser, the expansion apparatus, and the evaporator.

When the compressor is installed in the refrigerant compression type refrigeration cycle, a predetermined amount of oil is required for lubrication of a drive, sealing of a compression device, and cooling. The predetermined amount of oil is filled in a shell of the compressor. However, some of the oil may be mixed with the refrigerant discharged out of the compressor, and the discharged oil may circulate via the condenser, the expansion apparatus, and the evaporator together with the refrigerant. When an excessive amount of oil circulates along the refrigeration cycle or a large amount of oil remains in the refrigeration cycle without being collected back into the compressor, a lack of oil within the compressor may result. This may result in lowering of reliability of the compressor, and accordingly, lowering of a heat exchange performance of the refrigeration cycle.

Scroll compressors are well known. A scroll compressor may include an oil separator installed at a discharge side of the compressor, an oil pump that collects oil separated by the oil separator, and an oil collection pipe that connects the oil separator to the oil pump. In such a scroll compressor, if an inner space of the shell is at a discharge pressure, oil separated by the oil separator may be smoothly collected. However, as the oil pump is installed at a lower end of a crankshaft of the scroll compressor, a pumping force may not be strong during low speed driving of the compressor. This may cause a reliability of the compressor to be lowered or reduced.

A scroll compressor using differential pressure has been introduced as a technology for maintaining a predetermined amount of pumped oil during low speed driving of the compressor. In such a scroll compressor, a differential pressure hole, which may communicate with the inner space of the shell as a high pressure part with a suction chamber as a low pressure part, may be formed at or in an orbiting scroll. Accordingly, oil may be quickly supplied into the suction chamber using a pumping force of an oil pump and an attractive force generated due to the pressure difference. This allows the oil to be smoothly pumped during low speed driving, enhancing reliability of the compressor.

However, in such a scroll compressor for supplying oil into a compression chamber using differential pressure, smooth supply of the oil into the compressor chamber during low speed driving is allowed, but such oil is supplied into the compressor in a high pressure state, or more than an appropriate amount oil is supplied into the compression chamber, causing a suction loss.

Figure 2:
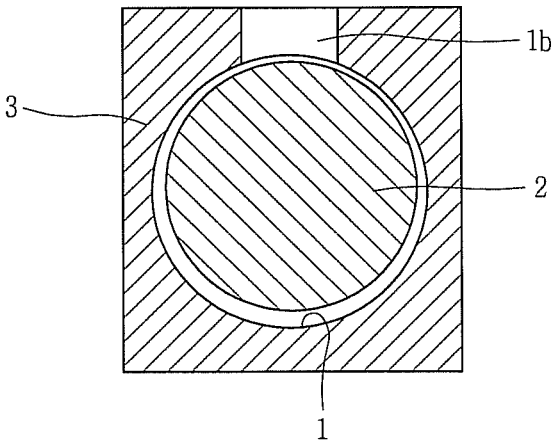
FIG. 2 is a sectional view taken along the line "II-II" of FIG. 1.

Taking this into account, a scroll compressor may employ a decompression device in which a pin member 2 is inserted into a differential pressure hole 1 to function as a type of orifice, as shown in FIGS. 1-2. The differential pressure hole 1 may have an inlet 1*a*, which may be formed inside a boss portion 3*a* of an orbiting scroll 3. A pin supporting portion 1*c* that supports the pin member 2 in a lengthwise direction may be formed at an inner circumferential surface of the differential pressure hole 1 in a stepped state.

In such a decompression device, the pin member 2 may be placed at a position where it always overlaps an outlet 1*b* of the differential pressure hole 1 due to the pin supporting portion 1*c*. The pin member 2 may narrow the outlet 1*b* of the differential pressure hole 1 due to oil introduced between the pin member 2 and the differential pressure hole 1 via the inlet 1*a*. Accordingly, pressure and an amount of oil supplied into the suction chamber via the outlet 1*b* of the differential pressure hole 1 may be appropriately adjusted.

However, in such a scroll compressor, oil pressure and oil amount may be adjusted as the pin member 2 blocks a part of the outlet 1*b* of the differential pressure hole 1. Thus, in order for the pin member 2 to always block the part of the outlet 1*b* of the differential pressure hole 1, the pin supporting portion 1*c*, which limits the position of the pin member 2, has to be stepped with respect to the differential pressure hole 1, which makes processing of the orbiting scroll complicated.

Further, as the inlet 1*a* of the differential pressure hole 1 is formed inside the boss portion 3*a* of the orbiting scroll, oil sucked up from the crankshaft may not be sufficiently supplied to a thrust bearing surface between the orbiting scroll and a frame. This may cause frictional loss and abrasion of the thrust bearing surface.

Figure 3:
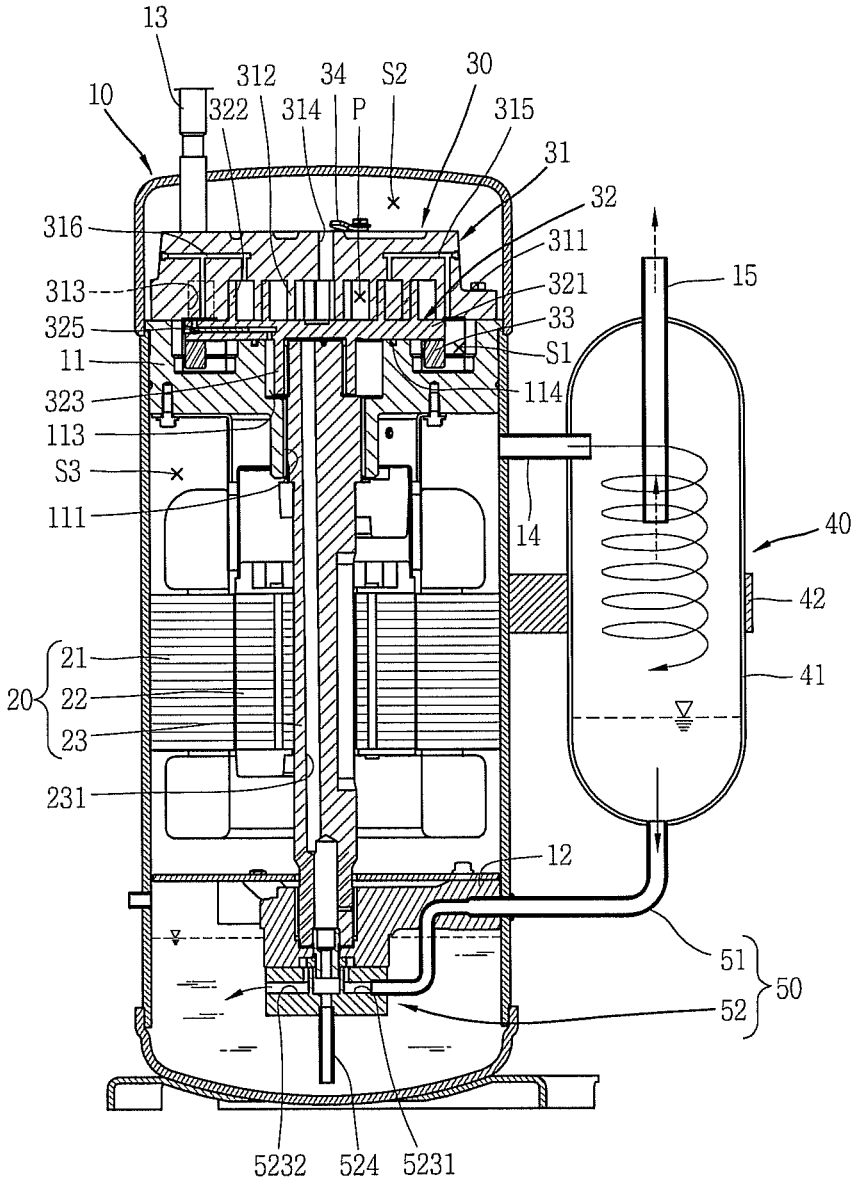
FIG. 3 is a longitudinal sectional view of internal structure of a scroll compressor in accordance with an embodiment.
Figure 4:
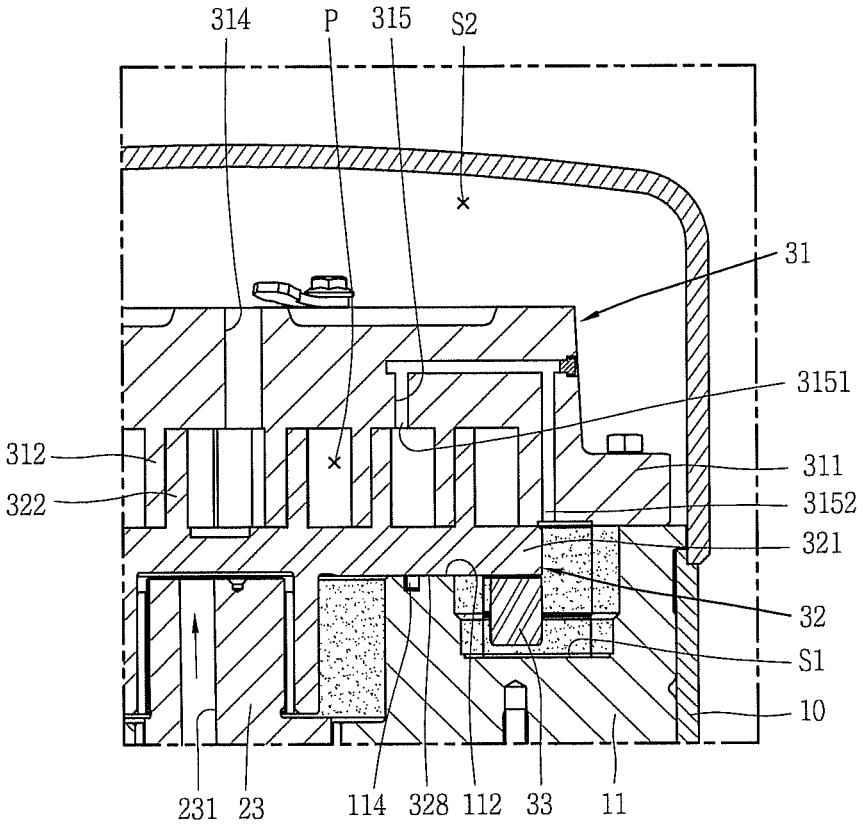
FIG. 4 is a longitudinal sectional view of a portion of a compression device illustrating a back pressure passage in the scroll compressor of FIG. 3.

FIG. 3 is a longitudinal sectional view of internal structure of a scroll compressor in accordance with an embodiment, and FIG. 4 is a longitudinal sectional view of a portion of a compression device for illustrating a back pressure passage in the scroll compressor of FIG. 3.

As shown in FIG. 3, a scroll compressor according to this embodiment may include a shell 10 having a sealed inner space, a drive motor 20 installed in the inner space of the shell 10, and a compression device 30 having a fixed scroll 31 and a orbiting scroll 32, which are driven by the drive motor 20 to compress a refrigerant.

The shell 10 may have an inner space filled with refrigerant at a discharge pressure. A suction pipe 13 may penetrate through one side of the shell 10 so as to communicate with a suction groove 313 (or suction chamber) of the fixed scroll 31, and a discharge pipe 14 may be connected to another side of the shell 10 to guide a refrigerant discharged into the inner space of the shell 10 toward a refrigeration cycle system.

The drive motor 20 may include a stator 21, which may be wound with a winding coil in a concentrated winding manner. The drive motor 20 may be implemented as a constant speed motor, in which a rotor 22 rotates at a same rotation speed. Alternatively, the drive motor 20 may be implemented as an inverter motor, in which the rotation speed of the rotor 22 is variable, taking multifunctional refrigerating devices having a compressor into account. Also, the drive motor 20 may be supported by a main frame 11 and a sub frame 12, which may be fixed to upper and lower sides of the shell 10.

The compression device 30 may include the fixed scroll 31, which may be coupled to the main frame 11, the orbiting scroll 32, which may be engaged with the fixed scroll 31 to define a pair of compression chambers P that continuously move, an Oldham ring 33 installed between the orbiting scroll 32 and the main frame 11 to induce an orbiting motion of the orbiting scroll 32, and a check valve 34 installed to open and close the discharge hole 314 of the fixed scroll 31 so as to block gas discharged via the discharge hole 314 from back flowing.

The fixed scroll 31 may include a fixed wrap 312 formed at a lower surface of a disc portion 311 that defines the compression chambers P, the suction groove 313, which may be formed at an edge of the disc portion 311, and the discharge hole 314, which may be formed at a central portion of the disc portion 311. The suction pipe 13 may be directly connected to the suction groove 313 of the fixed scroll 31 so as to guide refrigerant from a refrigeration cycle system into the scroll compressor.

The orbiting scroll 32 may include an orbiting wrap 322 formed at an upper surface of a disc portion 321 that defines the compression chambers P by being engaged with the fixed wrap 312, and a boss portion 323 formed at a lower surface of the disc portion 321 and coupled with a crankshaft 23. The boss portion 323 may be orbitably inserted into a shaft receiving portion 113, which may extend to a shaft receiving hole 111 of the main frame 11 and may be formed at or in a thrust bearing surface 112 to have a preset depth.

A back pressure chamber S1, which may be defined as an intermediate pressure space by the orbiting scroll 32, the fixed scroll 31, and the main frame 11, may be formed at an edge of a rear surface of the orbiting scroll 32. A sealing member 114 may be installed between the main frame 11 and the orbiting scroll 32 to prevent oil sucked up via an oil passage 231 of the crankshaft 23 from being excessively introduced into the back pressure chamber S1. The sealing member 114 may be located between the shaft receiving portion 113 of the main frame 11 and the back pressure chamber S1.

Referring to FIG. 4, a back pressure hole 315 may be formed at or in the fixed scroll 31. The back pressure hole 315 may serve to induce a portion of a refrigerant from an intermediate compression chamber having intermediate pressure, between suction pressure and discharge pressure, toward the back pressure chamber S1 so as to support an edge of the orbiting scroll 32 in a thrusting direction. The back pressure hole 315 may include a first open end 3151 that communicates with the compression chambers P, and a second open end 3152 that communicates with the first open end 3151 and also the back pressure chamber S1. The first open end 3151 of the back pressure hole 315 may be located at a position in which it may independently communicate with both compression chambers P in an alternating manner and may be thinner than a wrap thickness of the orbiting wrap 322, preventing leakage of refrigerant in both compression chambers P.

Figure 5:
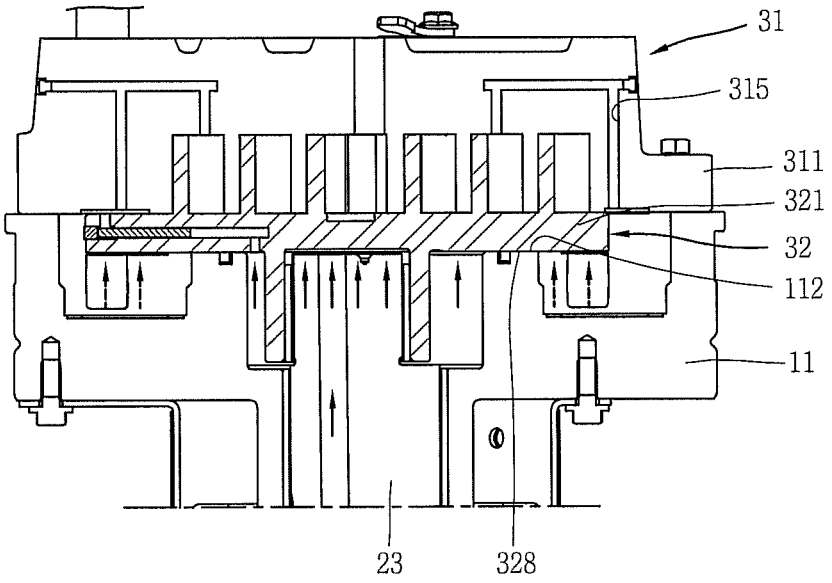
FIG. 5 is a schematic view illustrating a sealing effect between a fixed scroll and an orbiting scroll by the back pressure passage of FIG. 4.

With this configuration of the scroll compressor, when power is applied to the drive motor 20, the crankshaft 23 may rotate together with the rotor 22 to transfer a rotational force to the orbiting scroll 32. Upon receipt of the rotational force, the orbiting scroll 32 may orbit by an eccentric distance from an upper surface of the main frame 11 via the Oldham ring 33. Accordingly, a pair of compression chambers P which continuously move may be formed between the fixed wrap 312 of the fixed scroll 31 and the orbiting wrap 322 of the orbiting scroll 32. The compression chambers P may be reduced in volume while moving toward a center due to the continuous orbiting motion of the orbiting scroll 32, compressing a sucked refrigerant. Referring to FIG. 5, a central portion of the orbiting scroll 32 may be supported by oil introduced into the shaft receiving portion 113 while a side portion of the orbiting scroll 32 may be supported by refrigerant introduced from the compression chambers P into the back pressure chamber S1 via the back pressure hole 315. Consequently, the refrigerant within the compression chambers P may be smoothly compressed without being leaked.

The refrigerant compressed in the compression chambers P may be continuously discharged into an upper space S2 of the shell 10 via the discharge hole 314 of the fixed scroll 31, and may then flow into a lower space S3 of the shell 10, thereby being discharged into a refrigeration cycle system via the discharge pipe 14. An oil separating device 40 may be installed at a middle of the discharge pipe 14 to separate oil from the refrigerant, which may be discharged from the shell 10 into the refrigeration cycle system via the discharge pipe 14, and an oil collecting device 50 that collects the oil separated by the oil separating device 40 into the shell 10 may be installed on the oil separating device 40.

The oil separating device 40, as shown in FIG. 3, may include an oil separator 41 disposed at one side of the shell 10 in series, and an oil separation member (not shown) installed in the oil separator 41 that separates oil from refrigerant discharged from the compression device 30. The discharge pipe 14 may be connected to a middle of a side wall surface of the oil separator 41 to support the oil separator 41, or a supporting member 42, such as a clamp, may be disposed between the shell 10 and the oil separator 41 for support. A refrigerant pipe 15 may be connected to an upper end of the oil separator 41 to allow the separated refrigerant to flow into a condenser of the refrigeration cycle system. An oil collection pipe 51, which will be explained later, may be connected to a lower end of the oil separator 41 to guide the oil separated by the oil separator 41 to be collected into the shell 10 or the compression device 30 of the compressor.

The oil separating device 40 may employ various oil separation methods, such as installing a mesh screen in the oil separator 41, to separate oil from refrigerant, or connecting the discharge pipe in an inclined state to separate relatively heavy oil from refrigerant while the refrigerant rotates in a cyclone shape.

The oil collecting device 50 may include the oil collection pipe 51 connected to the oil separator 41 to guide oil separated by the oil separator 41 toward the shell 10, and an oil collection pump 52 connected to the oil collection pipe 51 to pump the oil separated by the oil separator 41 toward the shell 10. The oil collection pipe 51 may have one end connected to a lower end of the oil separator 41 and the other end connected to an inlet of the oil collection pump 52 via the shell 10. The oil collection pipe 51 may be made of, for example, a metal pipe having a predetermined rigidity to stably support the oil separator 41. Also, the oil collection pipe 51 may be curved by an angle so that the oil separator 41 is arranged in parallel to the shell 10 so as to attenuate vibration of the compressor. The oil collection pipe 51 may be coupled to a pump cover 523 of the oil collection pump 52, which will be explained later, using a communication hole (not shown) formed on or in the sub frame 12.

Figure 6:
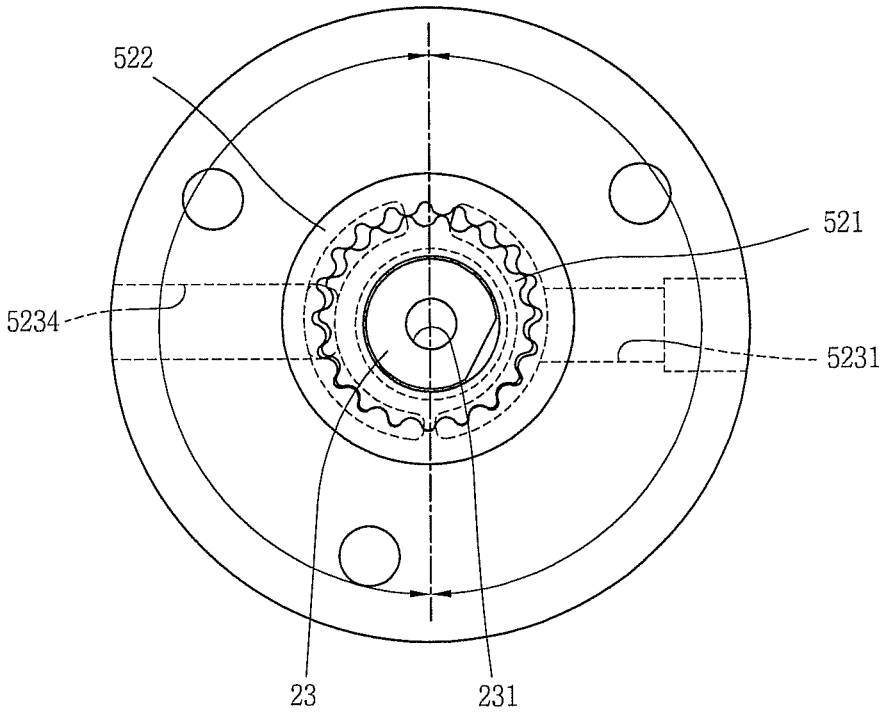
FIGS. 6 and 7-8 are a planar view and longitudinal sectional views, respectively, showing an oil collection pump of the scroll compressor of FIG. 3 according to embodiments.
Figure 7:
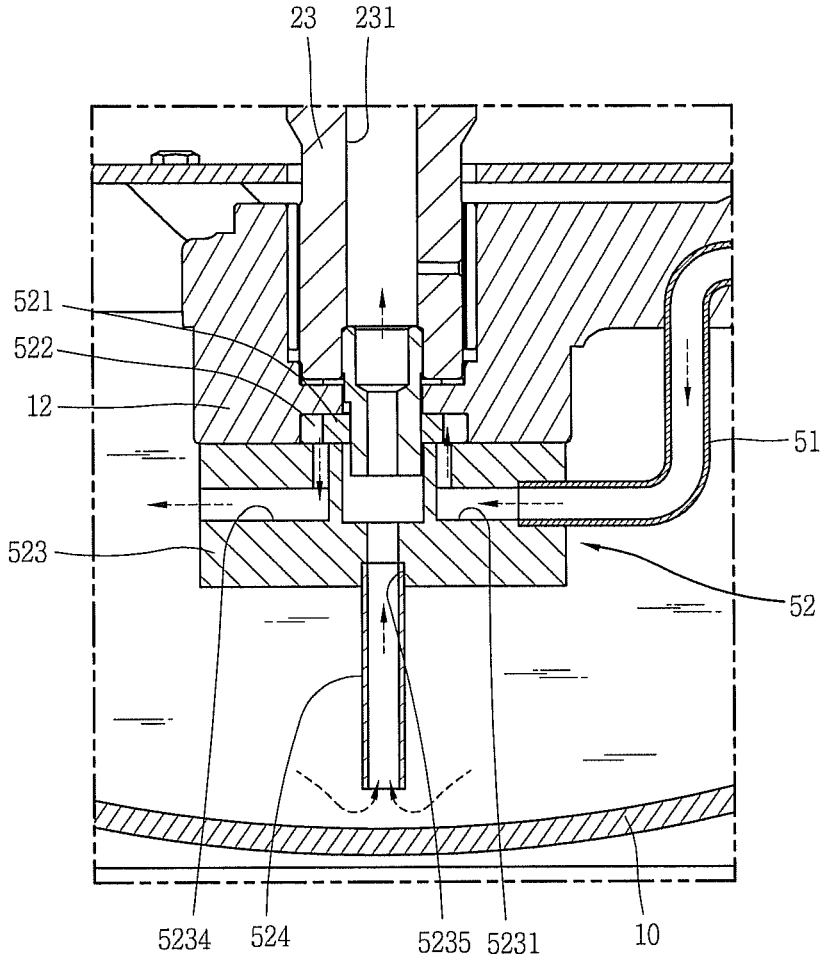
Figure 8:
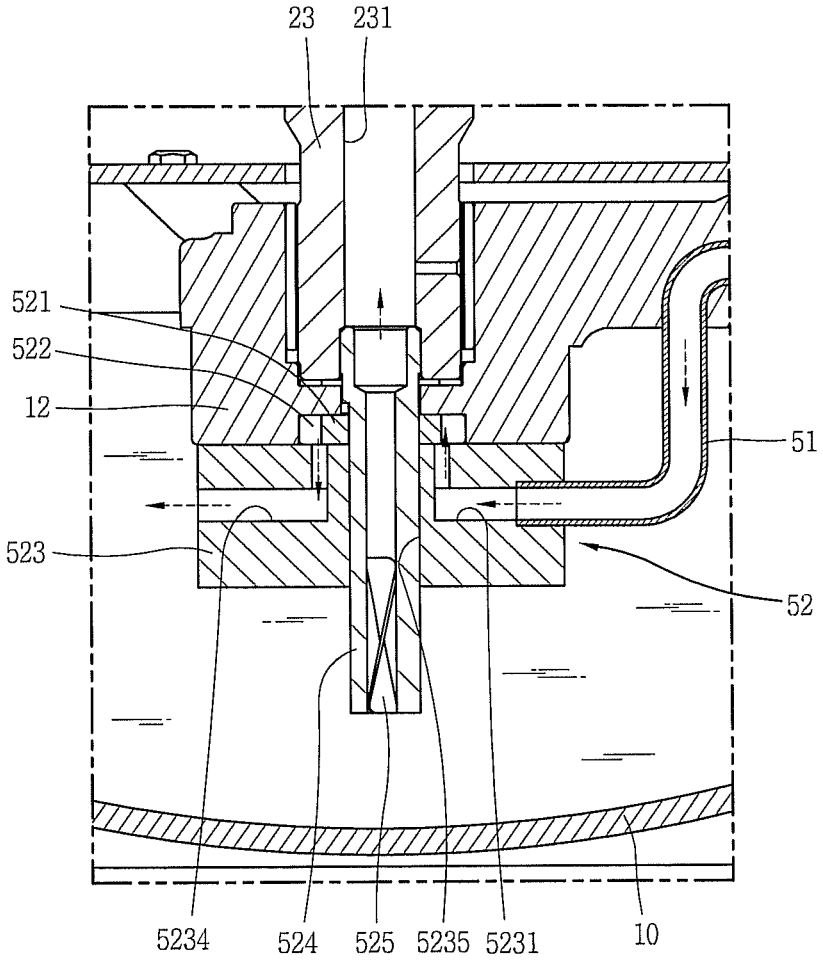

FIGS. 6 and 7-8 are a planar view and a longitudinal sectional views, respectively, showing an oil collection pump of FIG. 3 according to embodiments. As shown in FIGS. 6 and 7-8, the oil collection pump 52 may be implemented by employing various types of pumps. As shown in this exemplary embodiment, the oil collection pump 52 may be implemented as a trochoid gear pump which includes an inner gear 521 and an outer gear 522 engaged with each other to form a variable displacement.

The inner gear 521 may be coupled to the crankshaft 23 to be driven by a driving force of the drive motor 20. The inner gear 521 and the outer gear 522 may be received in the pump cover 523, which may be fixed to the sub frame 12. The pump cover 523 may include one inlet 5231 and one outlet 5234, which may communicate with the variable displacement of the oil collection pump 52, respectively. The inlet 5231 may communicate with the oil collection pipe 51 while the outlet 5234 may communicate with an oil storage of the lower space S3 of the shell 10.

An oil hole 5235, which may communicate with the oil passage 231 of the crankshaft 23, may be formed at a central portion of the pump cover 523. An oil supply pipe 524 may be coupled to the oil hole 5235 to guide oil stored in the inner space of the shell 10 toward the oil passage 231 of the crankshaft 23. Alternatively, as shown in FIG. 8, the oil supply pipe 524 may be directly coupled to the oil passage 231 of the crankshaft 23 via the oil hole 5235. When the oil supply pipe 524 is directly coupled to the crankshaft 23, a pumping member 525, such as a propeller, which may generate a pumping force, may be inserted in the oil supply pipe 524, to improve the oil pumping force when the oil supply pipe 524 rotates in response to rotation of the crankshaft 23.

The oil separator 41 of the scroll compressor having this configuration may separate oil from refrigerant, which is discharged from the inner space of the shell 10 into the refrigeration cycle system, and the separated oil may be collected back into the inner space of the shell 10 by the oil collection pump 52. In more detail, oil introduced into the compression chambers P may be discharged together with refrigerant to be introduced into the oil separator 41 via the discharge pipe 14. The oil may be separated from the refrigerant in the oil separator 41. The separated refrigerant may flow toward a condenser of the refrigeration cycle system via the refrigerant pipe 15, while the separated oil may be gathered at a bottom of the oil separator 41. As the crankshaft 23 of the drive motor 20 rotates, the inner gear 521 of the oil collection pump 52 may rotate to generate a pumping force and forming a variable displacement with the outer gear 522. The pumping force may be used to pump the oil separated by the oil separator 41. The oil pumped by the oil collection pump 52 may be collected into the lower space S3 of the shell 10, which may define the oil storage, via the oil collection pipe 51 and the oil collection pump 52.

The oil collected in the inner space of the shell 10 may be sucked up via the oil supply pipe 524 and the oil passage 231 of the crankshaft 23, thereby being supplied to a sliding (bearing) portion of the compression device 30. In accordance with embodiments disclosed herein, the inner space of the shell 10, which may define a relatively high pressure part, may communicate with the compression chambers P, which may define a relatively low pressure part, such that the oil collected in the inner space of the shell 10 may be sucked from the inner space of the shell 10 back into the compression chambers P by a pressure difference (differential pressure).

Figure 9:
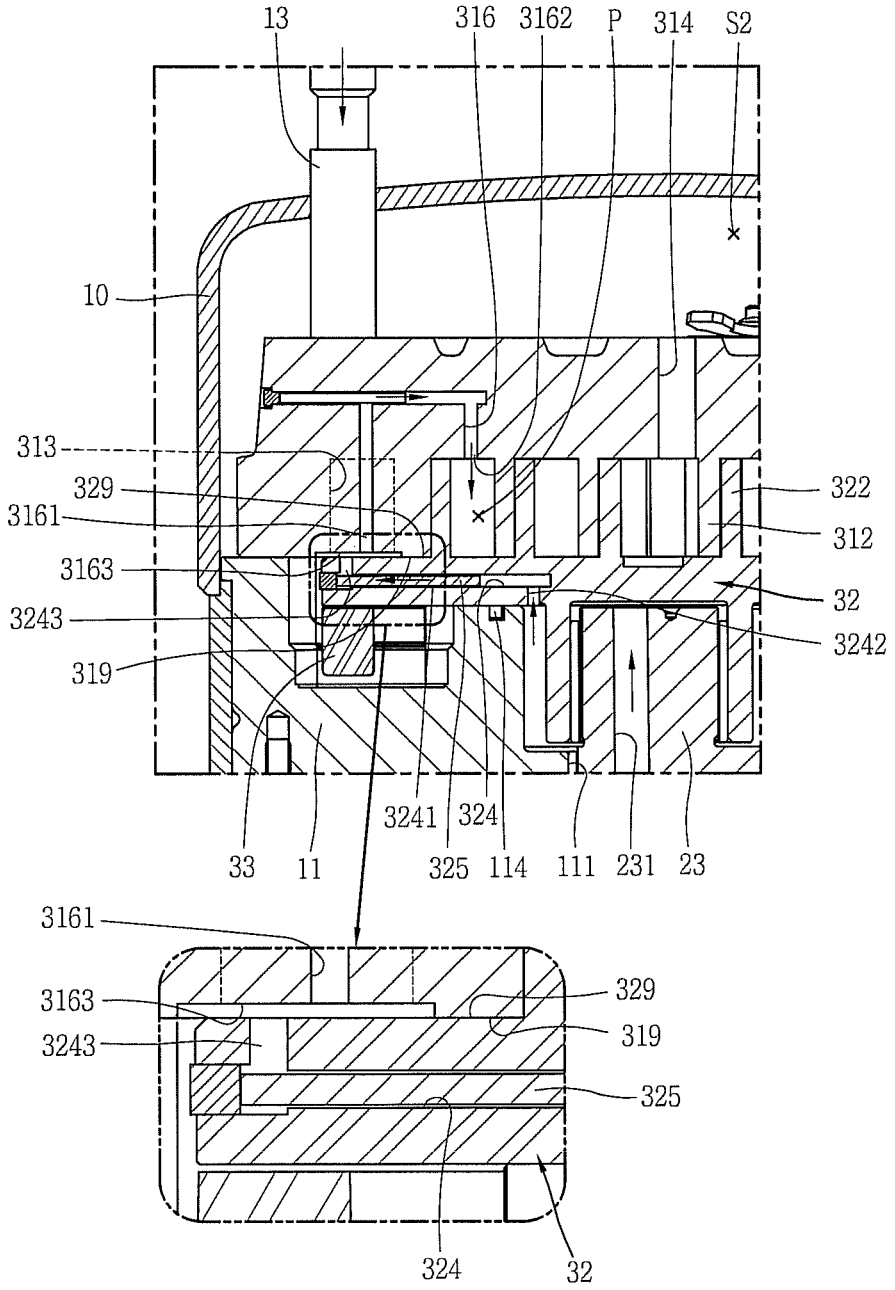
FIG. 9 is a longitudinal sectional view of a portion of a compression device showing a differential pressure passage in the scroll compressor of FIG. 3.
Figure 10:
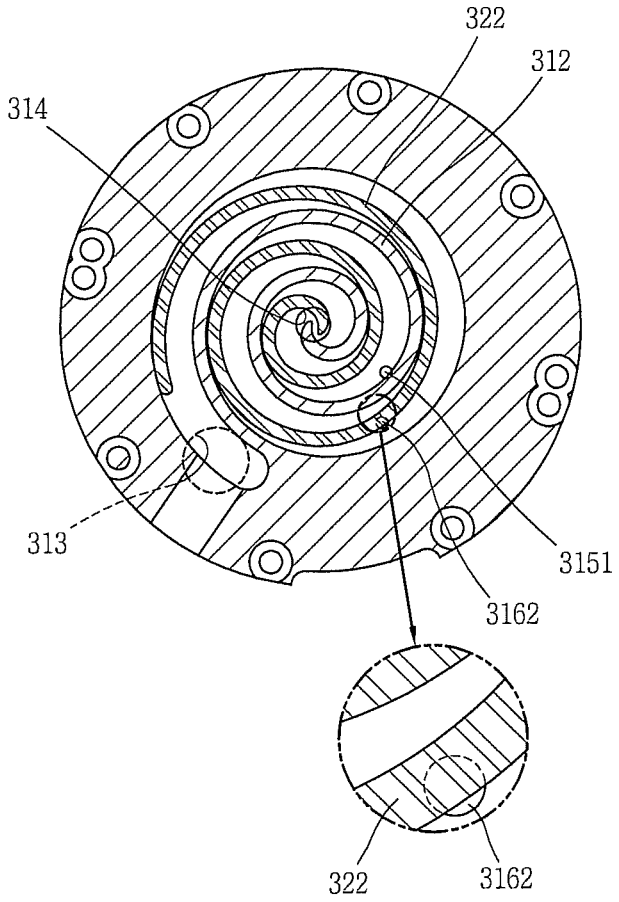
FIG. 10 is a planar view of the compression device illustrating positions of the back pressure passage and the differential pressure passage according to embodiments.

FIG. 9 is a longitudinal sectional view of a portion of a compression device showing a differential pressure passage in the scroll compressor of FIG. 3. FIG. 10 is a planar view of the compression device illustrating positions of the back pressure passage and the differential pressure passage according to embodiments. As shown in FIGS. 9 and 10, a communication hole 316 may be formed at or in the fixed scroll 31. The communication hole 316 may communicate from a thrust bearing surface (hereinafter, referred to as a first thrust surface) 319 contacting the orbiting scroll 32 to the compression chambers P. A differential pressure hole 324 may be formed at or in the orbiting scroll 32. The differential pressure hole 324 may guide oil sucked up via the oil passage 231 toward a thrust bearing surface (hereinafter, referred to as a second thrust surface) 329 contacting the fixed scroll 31.

The communication hole 316 may include a first open end 3161 that contacts the first thrust surface 319 and a second open end 3162 that communicates with the first open end 3161 and contacts the compression chambers P. The second open end 3162, as shown in FIG. 10, may be formed at a position closer to the suction groove (or suction chamber) 313 than the second open end 3152 of the back pressure hole 315, without overlapping the second open end 3152 of the back pressure hole 315.

When the second open end 3162 of the communication hole 316 is formed too close to a discharge side, it may increase pressure within the communication hole 316. This may interrupt smooth oil introduction or cause compression loss. Hence, as shown in FIG. 10, an opening time point of the second open end 3162 as an outlet of the communication hole 316 may be within approximately −60°, based on a crank angle, from a suction-completed time point, namely, a time point when an outer surface of an outer end of the orbiting wrap 322 contacts an inner surface of an outer end of the fixed warp 312. Also, the second open end 3162 of the communication hole 316 may be formed at a position where it may independently communicate with both compression chambers P in an alternating manner so as to supply oil into the both compression chambers P. In addition, the second open end 3162 of the communication hole 316 may be formed such that an inner diameter thereof is not be greater than a wrap thickness of the orbiting wrap 322 to prevent leakage of refrigerant between the compression chambers P.

Figure 11:
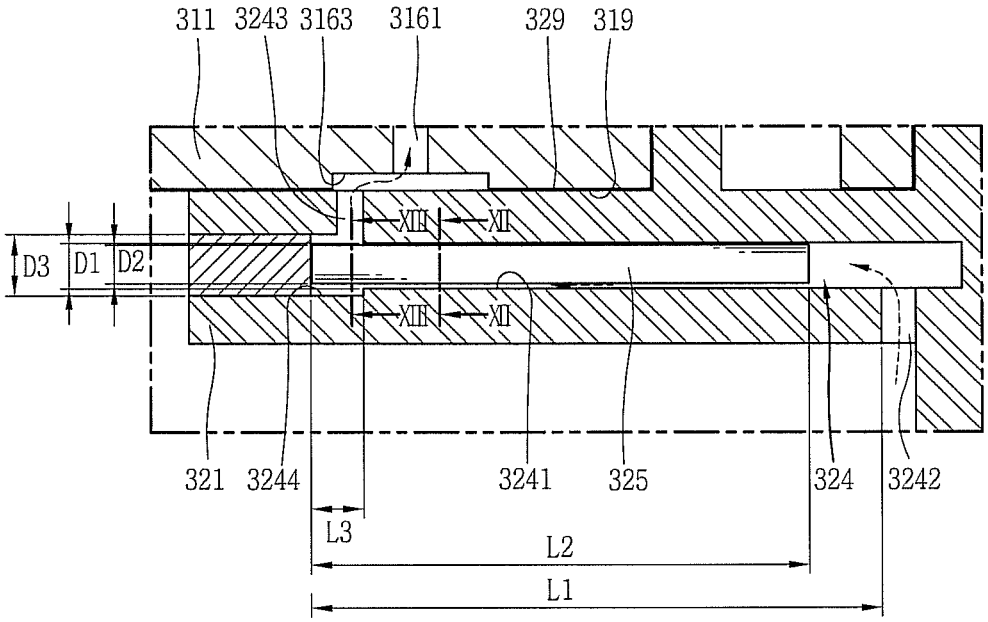
FIG. 11 is a longitudinal sectional view showing the differential pressure hole of FIG. 9 in an enlarged state.
Figure 12:
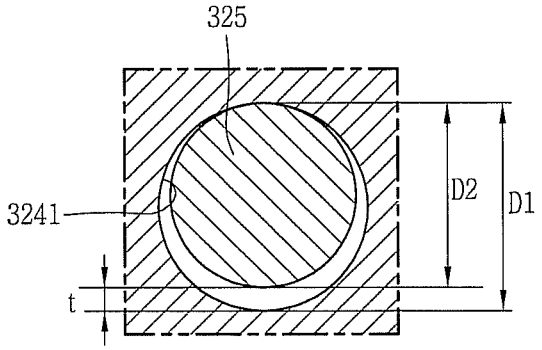
FIGS. 12 and 13 are sectional views taken along the lines "XII-XII" and "XIII-XIII" of FIG. 11, respectively.
Figure 13:
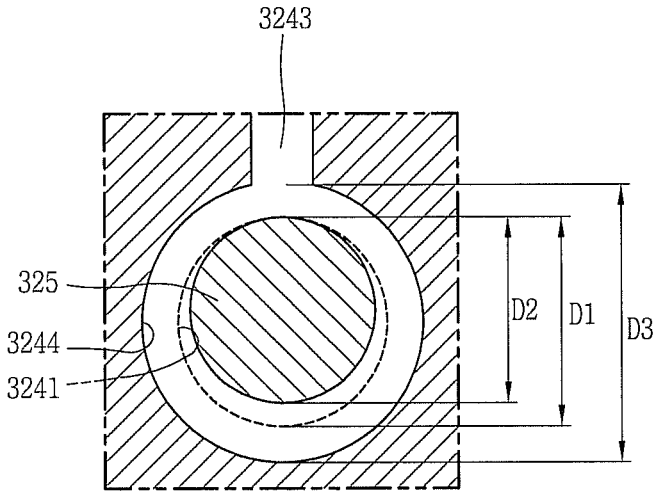

FIG. 11 is a longitudinal sectional view showing the differential pressure hole of FIG. 9 in an enlarged state, and FIGS. 12 and 13 are sectional views taken along the lines "XII-XII" and "XIII-XIII" of FIG. 11, respectively. As shown in FIGS. 11 to 13, the differential pressure hole 324 may penetrate through a center of the disc portion 321 of the orbiting scroll 32 toward an outer circumferential surface in a radial direction. The differential pressure hole 324 may include a decompression portion 3241, in which the pin member 325 is slidably inserted in a radial direction to decompress oil pressure.

An inner diameter D1 of the decompression portion 3241 may be slightly greater than an outer diameter D2 of the pin member 325, such that pressure of oil introduced into the decompression portion 3241 may be decompressed while the oil flows between the decompression portion 3241 and the pin member 325.

An inlet 3242 of the differential pressure hole 324 may be formed at one end portion of the decompression portion 3241, such that oil may be introduced into the decompression portion 3241 therethrough. An outlet 3243 of the differential pressure hole 324 may be formed at the other end portion of the decompression portion 3241, such that the oil passing through the decompression portion 3241 may be discharged to the thrust bearing surface 329 between the orbiting scroll 32 and the fixed scroll 31 so as to flow toward the communication hole 316.

A length L1 between the inlet 3242 and the outlet 3243 of the differential pressure hole 324 may be longer than a length L2 of the pin member 235, such that the pin member 325 may be slidable within the decompression portion 3241.

The inlet 3242 of the differential pressure hole 324 may be formed such that the oil sucked via the oil passage 231 may be introduced into the inlet 3242 of the differential pressure hole 324 after lubrication between the boss portion 323 of the orbiting scroll 32 and the shaft receiving portion 113 of the main frame 11, deriving a smooth lubrication of the orbiting scroll 32. Referring to FIG. 10, the inlet 3242 of the differential pressure hole 324 may be positioned outside of an outer circumferential surface of the boss portion 323 based on a center of the boss portion 323, namely, between the shaft receiving portion 113 and the sealing member 114.

A communication groove 3163, which may have a sectional area greater than that of the differential pressure hole 324 or the communication hole 316, may be formed at at least one of the outlet 3243 of the differential pressure hole 324 or the first open end 3161 of the communication hole 316 (the communication groove 3163 is formed at the first open end 3161 of the communication hole 316 in the drawings). This may result in an increase in an amount of oil sucked.

An expansion portion 3244, which may have an inner diameter D3 greater than the inner diameter D1 of the decompression portion 3241 to expand oil passing through the decompression portion 3241, may be formed near the outlet 3243 of the differential pressure hole 324. The decompression portion 3241 may communicate with the expansion portion 3244. A length L3 of the expansion portion 3244 may be formed shorter than the length L2 of the pin member 325, such that the pin member 325 may extend over the expansion portion 3244 and the decompression portion 3241.

In the scroll compressor having such a configuration, the oil stored in the inner space of the shell 10 may be sucked into the compression chambers P as a low pressure part by the pressure difference.

Figure 14:
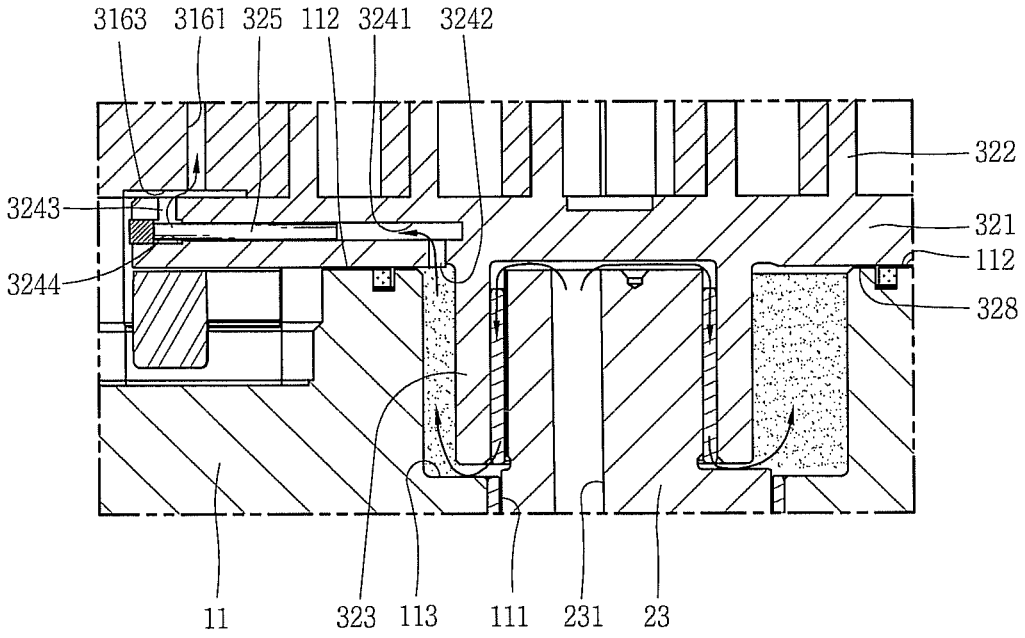
FIG. 14 is a longitudinal sectional view illustrating a process of supplying oil via the differential pressure passage of FIG. 9.

FIG. 14 is a longitudinal sectional view illustrating a process of supplying oil via the differential pressure passage of FIG. 9. As shown in FIG. 14, oil introduced into the boss portion 323 of the orbiting scroll 32 via the oil passage 231 of the crankshaft 23 may flow toward an outer circumferential surface of the boss portion 323 and then move onto the thrust bearing surface between the orbiting scroll 32 and the main frame 11. The oil moving to the thrust bearing surface between the main frame 11 and the orbiting scroll 32 may be partially introduced into the decompression portion 3241 via the inlet 3242 of the differential pressure hole 324.

The oil introduced into the decompression portion 3241 may flow to the outlet 3243 of the differential pressure hole 324 via a gap (t) (see FIG. 12), which may be formed between an inner circumferential surface of the decompression portion 3241 and an outer circumferential surface of the pin member 325, or to the expansion portion 3244 when the expansion portion is formed. Such oil then may flow to the thrust bearing surfaces 319 and 329 between the fixed scroll 31 and the orbiting scroll 32 via the outlet 3243 of the differential pressure hole 324. Afterwards, the oil may be introduced into the first open end 3161 of the communication hole 316 to be guided into the suction chamber 313 via the second open end 3162 of the communication hole 316.

Figure 15:
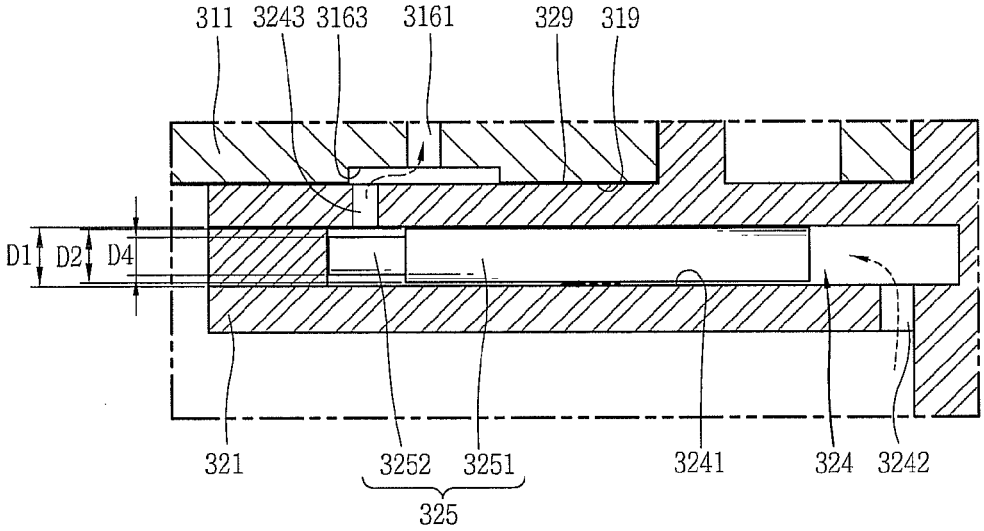
FIG. 15 is a longitudinal sectional view showing another example of the differential pressure hole of FIG. 9 in an enlarged state.

The expansion portion may alternatively be formed at or on the pin member. For example, as shown in FIG. 15, by maintaining the same inner diameter D1 of the decompression portion 3241, the pin member 325 may be stepped to have a large diameter part 3251 and a small diameter part 3252. The small diameter part 3252 may be defined as the expansion portion. When the expansion portion is formed at or on the pin member, the operating effect may be the same or similar to the aforementioned embodiments, so respective description has been omitted.

Figure 16:
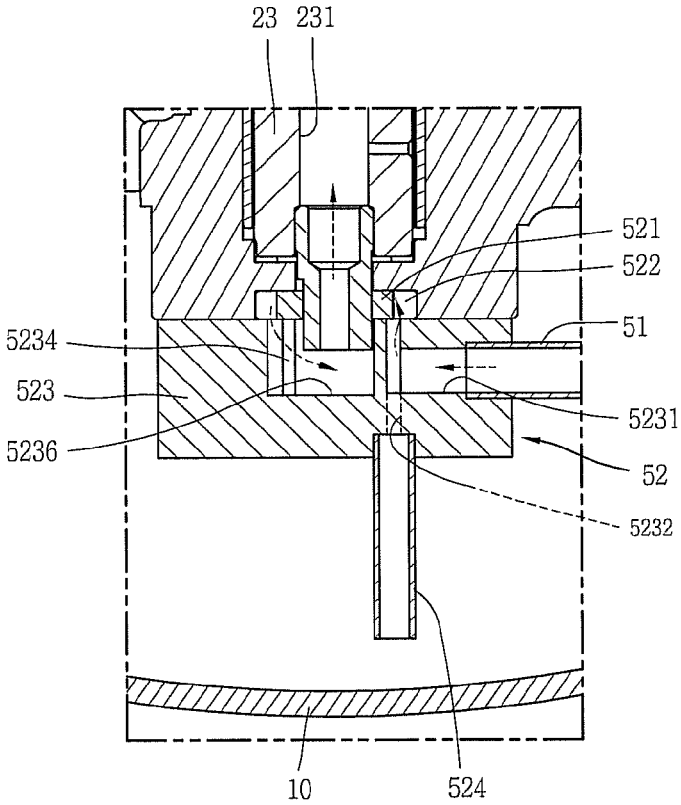
FIG. 16 is a longitudinal sectional view of an oil collection pump in accordance with another embodiment.

Hereinafter, description will be given of an oil supply apparatus for a scroll compressor according to another embodiment. That is, in the aforementioned embodiment, the oil collection pump has one inlet and one outlet, such that the inlet communicates with the oil collection pipe and the outlet communicates with the inner space of the shell, respectively. However, in this embodiment, the oil collection pump 52, as shown in FIG. 16, may include two inlets 5231 and 5232 and one outlet 5234.

With this structure, the two inlets 5231 and 5232 of the oil collection pump 52 may communicate with the oil collection pipe 51 and the inner space of the shell 10, respectively, while the one outlet 5234 may communicate directly with the oil passage 231 of the crankshaft 23. An oil storage 5236 that stores a predetermined amount of oil may further be formed in the outlet 5234. The oil storage 5236 may communicate with the oil passage 231 of the crankshaft 23.

Even in the scroll compressor having this configuration, pressure of the oil passage 231, more particularly, pressure of the oil storage 5236 of the pump cover 523 may become higher than the pressure of the compression chambers P. Accordingly, oil collected via the oil collection pipe 51 and oil pumped up from the inner space of the shell 10 may be sucked into the compression chambers P not only by the differential pressure, but also by the pumping force of the oil collection pump 52. This may allow the oil to be smoothly supplied even during low speed driving and at the beginning of the driving.

Hereinafter, description will be given of an oil supply apparatus for a scroll compressor according to another embodiment.

Figure 17:
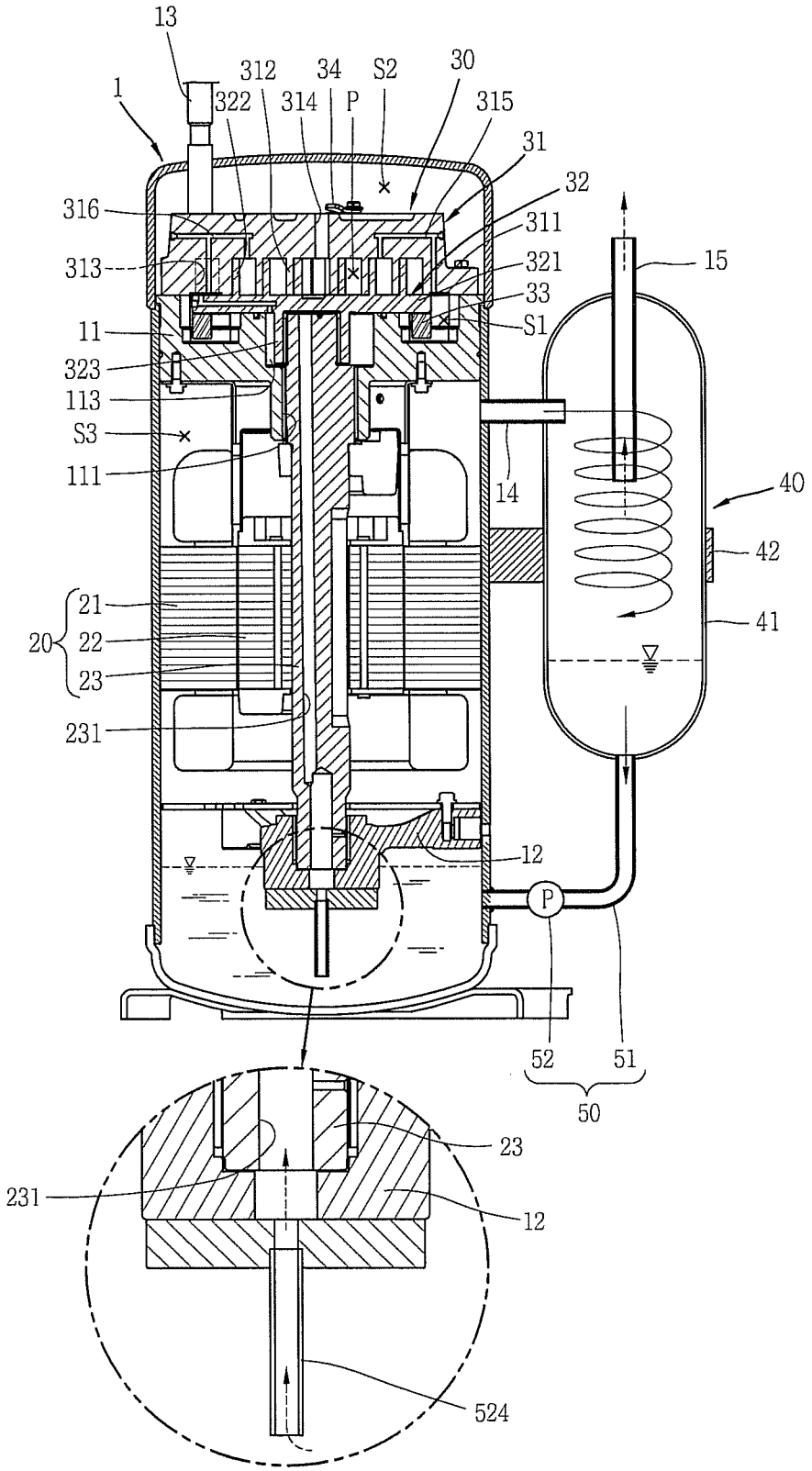
FIG. 17 is a longitudinal sectional view of a scroll compressor having an oil collection pump disposed outside of a shell in accordance with another embodiment.

That is, the aforementioned embodiments have illustrated that the oil collection pump is installed inside the shell or coupled to the drive motor to use the driving force of the drive motor. However, in this embodiment, as shown in FIG. 17, the oil collection pump 52 of the oil collecting device 50 may be installed outside of the shell 10 and driven using a drive source separate from the drive motor 20. To this end, the oil collection pump 52 may be installed at a middle of the oil collection pipe 51 outside of the shell 10, and an inverter motor, whose rotation speed increases or decreases cooperative with the rotation speed of the drive motor 20, may be installed. The outlet of the oil collection pipe 51 may be connected directly to the oil passage 231 of the crankshaft 23, but in some cases, connected to the inner space of the shell 10.

In the scroll compressor having such a configuration, the basic configuration of pumping oil into the compression chambers and its operating effect may be the same or similar to the aforementioned embodiments. However, in the scroll compressor according to this embodiment, the pump, which pumps oil, may be installed outside of the shell 10, rather than inside the shell 10, and the oil collection pipe 51 may communicate with the inner space of the shell 10. Accordingly, foreign materials contained in the oil may be filtered in the inner space of the shell 10. This may prevent contamination of the oil supplied to the thrust surfaces or the compression chambers P in advance. Also, installation of the oil collection pump 52 outside of the shell 10 may facilitate maintenance and management of the oil collection pump 52.

The foregoing embodiments have exemplarily illustrated a scroll compressor. However, the present disclosure may be applied equally to a so-called hermetic compressor, such as a rotary compressor, in which a drive motor and a compression device are installed inside the same shell, without being limited to the scroll compressor.

Embodiments disclosed herein provide a scroll compressor capable of facilitating processing of an orbiting scroll by simplifying a structure of a differential pressure hole for insertion of a pin member therein. Further, embodiments disclosed herein provide a scroll compressor capable of reducing frictional loss and abrasion by allowing oil to be sufficiently supplied between an orbiting scroll and a frame.

Embodiments disclosed herein provide a scroll compressor that may include a shell having an inner space filled with refrigerant discharged to the inner space, the inner space containing a predetermined amount of oil, a drive motor installed in the shell, a crankshaft coupled to a rotor of the drive motor and having an oil passage formed therethrough, a fixed scroll fixed to the shell and having a fixed wrap, and an orbiting scroll having an orbiting wrap engaged with the fixed wrap, the orbiting scroll forming compression chambers together with the fixed scroll while orbiting with respect to the fixed scroll. The orbiting scroll may include a differential pressure hole that communicates a high pressure part formed in the inner space of the shell with an intermediate pressure part formed between the fixed scroll and the orbiting scroll. The differential pressure hole may include a decompression portion having a pin member inserted therein that decompresses oil. An inner diameter D1 of the decompression portion may be greater than an outer diameter D2 of the pin member. The decompression portion may include an inlet through which oil may be introduced from the high pressure part into the differential pressure hole, and an outlet through which oil from the differential pressure hole may be discharged into the intermediate pressure part. A length L1 between the inlet and the outlet may be longer than a length L2 of the pin member.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As present features may be embodied in several forms without departing from characteristics thereof, it should also be understood that the above-described embodiments are not limited by any of the details of the foregoing description, unless otherwise specified, but rather, should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a shell having an inner space configured to be filled with refrigerant, the inner space containing a predetermined amount of oil;

a drive motor installed in the shell;

a crankshaft coupled to the drive motor and having an oil passage formed therethrough;

a fixed scroll fixed to the shell and having a fixed wrap; and an orbiting scroll having an orbiting wrap engaged with the fixed wrap, the orbiting scroll forming compression chambers together with the fixed scroll while orbiting with respect to the fixed scroll, wherein the orbiting scroll comprises a differential pressure hole that communicates a high pressure space formed in the inner space of the shell with an intermediate pressure space formed between the fixed scroll and the orbiting scroll, and wherein the differential pressure hole comprises a decompression portion having a pin member inserted therein that decompresses oil, wherein an inner diameter of the decompression portion is greater than an outer diameter of the pin member, and wherein the fixed scroll comprises a communication hole having a first open end that communicates with the high pressure space, and a second open end that communicates with the first open end and a low pressure space between the fixed scroll and the orbiting scroll.

2. The scroll compressor of claim 1, wherein the differential pressure hole includes an inlet that communicates with the high pressure space and an outlet that communicates with the intermediate pressure space.

3. The scroll compressor of claim 2, wherein a length between the inlet and the outlet is longer than a length of the pin member.

4. The scroll compressor of claim 3, wherein the differential pressure hole further comprises an expansion portion having an expanded inner diameter formed adjacent the outlet of the differential pressure hole.

5. The scroll compressor of claim 4, wherein a length of the expansion portion is shorter than the length of the pin member.

6. The scroll compressor of claim 2, wherein the orbiting scroll is supported on a frame, wherein the frame includes a shaft receiving portion configured to receive a boss portion of the crank shaft, and wherein the inlet of the differential pressure hole is positioned between the shaft receiving portion and a sealing member disposed between contacting surfaces of the orbiting scroll and frame.

7. The scroll compressor of claim 2, wherein the pin member comprises at least one stepped portion so as to have a large diameter portion and a small diameter portion.

8. The scroll compressor of claim 7, wherein the small diameter portion is formed at an end portion of the pin member, the end portion corresponding to the outlet of the differential pressure hole.

9. The scroll compressor of claim 1, wherein the second open end of the communication hole is open in a range of approximately 0 to −60° of a crank angle based on a suction-completed time point when a suction side end of the orbiting wrap contacts a side surface of the fixed wrap.

10. The scroll compressor of claim 1, wherein the orbiting scroll has a boss portion coupled with the crankshaft, and wherein the first open end of the communication hole is located outside of the boss portion in a radial direction based on a center of the boss portion.

11. The scroll compressor of claim 1, wherein the orbiting scroll is supported at or on a thrust bearing surface of a frame fixed to the shell, wherein the frame has a shaft receiving portion in which the boss portion is orbitably inserted and a sealing member is disposed between the thrust bearing surface of the frame and a thrust bearing surface of the orbiting scroll, which contacts the frame, and wherein the first open end of the communication hole is located outside of the sealing member.

12. The scroll compressor of claim 11, wherein a back pressure chamber is formed outside of the sealing member, and wherein the fixed scroll comprises a back pressure hole having a first end that communicates with the back pressure chamber and a second end that communicates with the compression chambers.

13. The scroll compressor of claim 12, wherein a diameter of the second end is thinner than a wrap thickness of the orbiting wrap.

14. The scroll compressor of claim 12, wherein the back pressure hole is formed at a position farther from a suction side than the communication hole based on a movement path of the compression chambers.

15. The scroll compressor of claim 1, further comprising an oil separator configured to separate oil from refrigerant discharged from the compression chambers.

16. The scroll compressor of claim 15, wherein the oil separator is installed to communicate with a discharge pipe outside of the shell, and communicates with the inner space of the shell via an oil collection pipe.

17. The scroll compressor of claim 16, wherein the crankshaft comprises an oil pump driven by a rotational force of the crankshaft, that pumps oil separated by the oil separator into the inner space of the shell, and wherein the oil collection pipe is connected to an inlet of the oil pump.

18. A scroll compressor, comprising:

a shell having an inner space configured to be filled with refrigerant, the inner space containing a predetermined amount of oil;

a drive motor installed in the shell;

a crankshaft coupled to the drive motor and having an oil passage formed therethrough;

a fixed scroll fixed to the shell and having a fixed wrap; and an orbiting scroll having an orbiting wrap engaged with the fixed wrap, the orbiting scroll forming compression chambers together with the fixed scroll while orbiting with respect to the fixed scroll, wherein the orbiting scroll comprises a differential pressure hole that communicates a high pressure space formed in the inner space of the shell with an intermediate pressure space formed between the fixed scroll and the orbiting scroll, wherein the differential pressure hole comprises a decompression portion having a pin member inserted therein that decompresses oil, and an expansion portion having an expanded inner diameter formed adjacent an outlet of the differential pressure hole, and wherein the pin member comprises at least one stepped portion so as to have a large diameter portion and a small diameter portion, and wherein the small diameter portion is formed at an end portion of the pin member, the end portion corresponding to the outlet of the differential pressure hole.

19. A scroll compressor, comprising:

a shell having an inner space configured to be filled with refrigerant, the inner space containing a predetermined amount of oil;

a drive motor installed in the shell;

a crankshaft coupled to the drive motor and having an oil passage formed therethrough;

a fixed scroll fixed to the shell and having a fixed wrap; and an orbiting scroll having an orbiting wrap engaged with the fixed wrap, the orbiting scroll forming compression chambers together with the fixed scroll while orbiting with respect to the fixed scroll, wherein the orbiting scroll comprises a differential pressure hole that communicates a high pressure space formed in the inner space of the shell with an intermediate pressure space formed between the fixed scroll and the orbiting scroll, and wherein the differential pressure hole comprises a decompression portion having a pin member inserted therein that decompresses oil, wherein an inner diameter of the decompression portion is greater than an outer diameter of the pin member, wherein the differential pressure hole includes an inlet that communicates with the high pressure space and an outlet that communicates with the intermediate pressure space, wherein a length between the inlet and the outlet is longer than a length of the pin member, and wherein the differential pressure hole further comprises an expansion portion having an expanded inner diameter formed adjacent the outlet of the differential pressure hole.

20. The scroll compressor of claim 19, wherein a length of the expansion portion is shorter than the length of the pin member.

* * * * *